United States Patent [19]

Lam

[11] Patent Number: 4,703,811

[45] Date of Patent: Nov. 3, 1987

[54] DRILLING AND/OR LIFTING MACHINE

[76] Inventor: Ming L. Lam, 5000 Marine Parade Road, Laguna Park, Blk. G04-27, Singapore - 1544, Singapore

[21] Appl. No.: 796,462

[22] Filed: Nov. 8, 1985

[30] Foreign Application Priority Data

| | | | |
|---|---|---|---|
| Nov. 8, 1984 | [GB] | United Kingdom | 8428285 |
| Jan. 4, 1985 | [GB] | United Kingdom | 8500189 |
| May 15, 1985 | [GB] | United Kingdom | 8512277 |
| Oct. 9, 1985 | [GB] | United Kingdom | 8524919 |

[51] Int. Cl.[4] ..... E21B 7/02; E21B 19/02

[52] U.S. Cl. ..... 173/28; 173/43; 173/164; 175/85; 175/162

[58] Field of Search ..... 175/52, 85, 135, 162, 175/202, 203; 173/43, 22, 28, 39, 42, 44, 164; 414/22, 745

[56] References Cited

U.S. PATENT DOCUMENTS

| | | | |
|---|---|---|---|
| 3,177,944 | 4/1965 | Knights | 414/22 |
| 3,181,623 | 5/1965 | Lindgren | 173/43 |
| 3,680,412 | 8/1972 | Mayer et al. | 173/164 |
| 3,840,128 | 10/1974 | Swoboda, Jr. et al. | 414/745 |
| 4,147,215 | 4/1979 | Hodge et al. | 173/164 |
| 4,364,540 | 12/1982 | Montabert | 173/43 |
| 4,403,666 | 9/1983 | Willis | 173/164 |

FOREIGN PATENT DOCUMENTS

| | | | |
|---|---|---|---|
| 2492881 | 4/1982 | France | 175/85 |

*Primary Examiner*—Z. R. Bilinsky

*Attorney, Agent, or Firm*—Armstrong, Nikaido, Marmelstein & Kubovcik

[57] ABSTRACT

This invention relates to a drilling and/or lifting machine, in particular a track-mounted drilling and lifting rig. The machine comprises a movable carriage, a first lifting and/or tool carrying device (A), a support (2, 4, 5) mounting the first lifting and/or tool carrying device (A) on the carriage to enable the first lifting and/or tool carrying device to be positioned in a selected one of a variety of different positions and a second lifting and/or tool carrying device (B) mounted on the carriage so as to be movable either with or independently of the first lifting and/or tool carrying device (A). The support is rotatably connected by a bearing member (3) to the first lifting and/or tool carrying device and connecting mechanism (6, HH', PP') connects the support to the first lifting and/or tool carrying device (A), the connecting mechanism being movable to rotate the first lifting and/or tool carrying device (A) relative to the support.

13 Claims, 13 Drawing Figures

ONE CYCLE

| | | | | | |
|---|---|---|---|---|---|
| LIFTING MAST SYSTEM | IDLE (FREE OF WORK) | IDLE (FREE OF WORK) | IDLE (FREE OF WORK) | PICKS UP 1st (N°1) CASING AND TRANSFERS THE CASING TO A STORAGE POSITION | IDLE (FREE OF WORK) |
| DRILLING MAST SYSTEM | DRILLING STOPPED 1st (N°1) CASING PULLED OUT OF GROUND | CLAMPING UNIT 17 CLAMPS 2nd (N°2) CASING AND ROTARY HEAD IS REVERSED TO DISCONNECT 1st AND 2nd CASINGS IF NECESSARY TWISTING UNIT 18 MAY BE USED TO ASSIST DISCONNECTION | TWISTING UNIT 18 CLAMPS 1st CASING ROTARY HEAD REVERSED TO DISCONNECT 1st CASING FROM ADAPTER 15 | ROTARY HEAD MOVES DOWN MAST AND THEN ROTATES TO CONNECT ADAPTER TO 2nd CASING, 2nd CASING PULLED OUT OF GROUND | CLAMPING UNIT 17 CLAMPS 3rd (N°3) CASING, ROTARY HEAD IS REVERSED TO DISCONNECT 2nd AND 3rd CASINGS |

TIME

FIG 11

$\alpha = \frac{36°}{2}$

DRILLING AND/OR LIFTING MACHINE

BACKGOUND OF THE INVENTION

This invention relates to a drilling and/or lifting machine, in particular a track-mounted drilling and lifting rig, for use in soil investigation, well drilling and like fields and especially for drilling at angles of from 0° to 90° to the vertical.

Currently available mini drilling machines are suitable for drilling the small diameter holes required for use in soil investigation, and the like but cannot be used for drilling the larger diameter bore holes required for, for example, forming wells. Furthermore, such drilling means cannot drill horizontal or angled bore holes and cannot therefore be used in the construction of galleries or foundations. However, if a drilling machine which is capable of drilling larger angles or horizontal bore holes is used, such a drilling machine cannot drill small bore holes, particularly in limited spaces. Furthermore, current machines cannot be used at sites where the ground is uneven.

Currently available soil investigation drilling machines are usually small in size and most have no suitable rotary head. Rather these machines use a winch together with a steel wire and a crown block to hoist elongate drill strings or casings. During hoisting, the machine must stop any drilling operation and open the rotary head to enable a further drill rod or casing to be added to the drill string to enable the bore to be lengthened or to enable a drill rod or casing to be removed from the bore. Thus the efficiency of these machines is low.

In some advanced soil investigation drilling machines it is not necessary to open the rotary head, however the whole machine must be slid backwards so as to be far from the center of the bore during hoisting so that lift and the drilling operations also can not be performed simultaneously with these machines.

In the field of water well drilling or oil well drilling, more than one hundred elongate well elements such as tubing, pipes and sucker rods are required to be hoisted successively. The center of the rig hoists used to lower the drill string into the well or to remove the string from the well usually coincide with the center of the bore. Some of the machines have another hoist at the front of the mast and may have two winch systems (bottom turntable rig). This kind of machine also cannot provide drilling and lifting functions simultaneously. When performing work such as placing a string at the hoisting position to connect or disconnect a member from the string and to run the string into the well or remove it from the well, several operators are required to work manually to fulfill the task, thus causing low efficiency.

A self-contained automatically operable well servicing and drilling rig is disclosed in UK Patent application No. 2,047,306A which is capable of picking up an elongate well element from a horizontal storage position to a vertical position. This machine can keep the manual work to a minimum and reduce the number of workers required but cannot drill angled holes or bores such as holes at an angle of 45° to the ground and work sizes. Also this machine cannot provide drilling and lifting functions simultaneously.

A well drilling rig described in UK Patent Specification No. 1,393,389 may provide a means of selecting a drill-casing segment (consisting of a drill pipe segment surrounded by a casing segment) from a storage rack (e.g. on a truck) and transferring the combined segments to a vertical drilling position directly over the well. But this kind of machine is big in size and its useful apparatus is very complicated. Also such machines can only drill in a vertical direction and cannot drill slanting holes such as holes or bores at an angle of 45° to the horizontal, that is at an angle of 45° to the surface in which the machine is working. Furthermore this kind of machine needs a large amount of space and area to operate in whereas the work site often has limited space and area and comprises muddy, soft and water ground.

OBJECT AND SUMMARY OF THE INVENTION

It is an object of the present invention to provide a drilling and/or lifting machine which overcomes or at least mitigates the above mentioned problems.

According to the present invention there is provided a machine comprising a movable carriage, a first lifting and/or tool carrying means, support means mounting the first lifting and/or tool carrying means on the carriage to enable the first lifting and tool carrying means to be positioned in a selected one of a plurality of different positions and a second lifting and/or tool carrying means mounted on the carriage so as to be movable either with or independently of the first lifting or tool carrying means.

According to a second aspect of the present invention, there is provided a machine which comprises a first lifting and/or tool carrying means, a carriage, a support means mounting the first lifting and/or tool carrying means to the carriage so that the first lifting and/or tool carrying means is rotatable about a first axis relative to the support means, and means connecting the support means to the first lifting and/or tool carrying means, the connecting means being movable to rotate the first lifting and/or tool carrying means relative to the support means.

A drilling and/or lifting machine embodying the invention is particularly suited for use in soil investigation and mine prospecting, mining, harbor construction, gallery, water well digging and the like. Moreover, it may be capable of drilling large dimensioned holes, for example holes of 14" (355.6 mm) in diameter and 10 m in depth as well as holes of small dimensions, for example 2 ½"to 6"(63.5 mm to 152.4 mm) in diameter and 30 m in depth. Furthermore, the machine can drill horizontal holes at both high and low levels and also holes which extend at an angle in either direction to the horizon.

BRIEF DESCRIPTION OF THE DRAWINGS

For a better understanding of the present invention, and to show how the same may be put into effect, reference will now be made, by way of example, to the accompanying drawings, in which:

FIG. 11 is a chart illustrating the sequence of operations of the lifting and drilling mast systems during removal of casings from a bore;

DETAILED DESCRIPTION OF A PREFERRED EMBODIMENT

Figure 1:
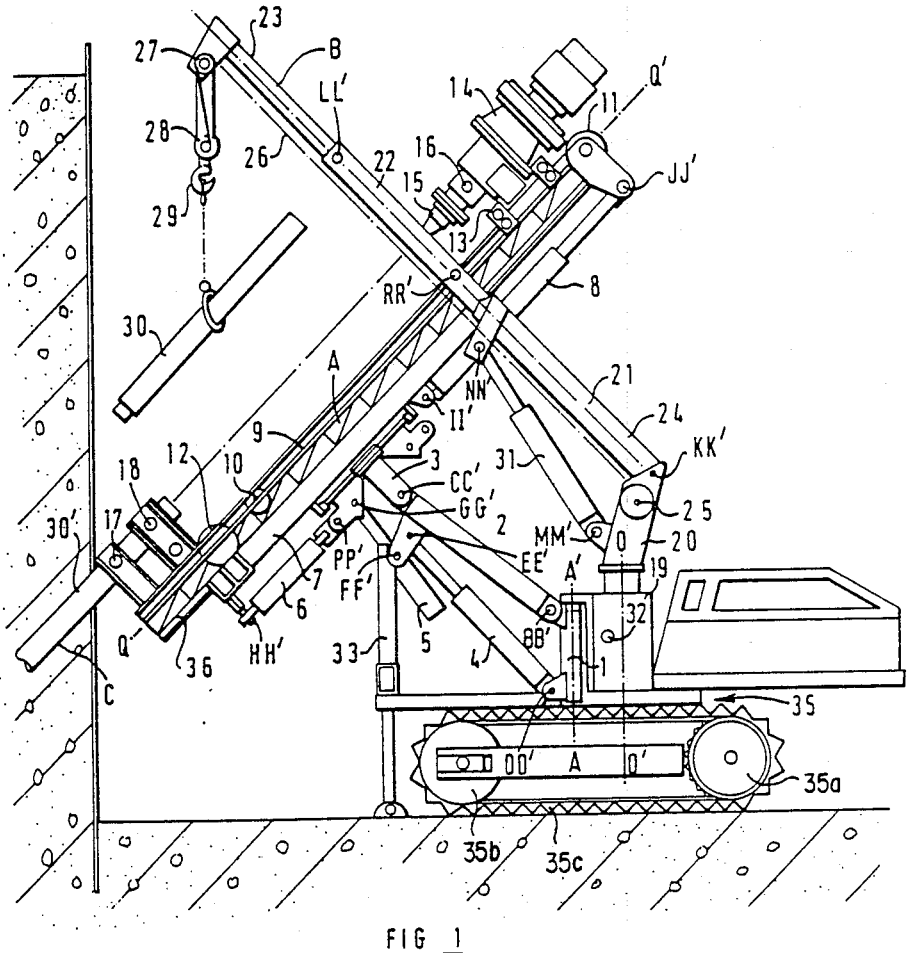
FIG. 1 is a side elevational view of a track-mounted drilling and lifting machine in accordance with the present invention with a drilling mast system thereof at a 45° downward angle to the vertical carrying out ground anchoring work.

Referring now to FIGS. 1 to 9 of the drawings, there is shown a multi-directional drilling and lifting machine which, as shown in FIG. 1, comprises a universally movable carriage having a chassis 35, a drilling mast system A and a lifting mast system B. The lifting system B can be operated either with or independently of the drilling system A which is capable of drilling in various different directions.

The movable carriage chassis 35 has driving chain wheels 35*a* mounted on either side thereof toward the rear of the carriage and driven chain wheels 35*b* aligned with the driving chain wheels 35*a* but mounted toward the front of the carriage. A respective track 35*c* is trained round each driving chain wheel 35*a* and the aligned driven chain wheel 35*b*. In the preferred arrangement, the position of the driven chain wheels 35*b* is adjustable so that the tension in the track 35*c* can be altered whereas the driving chain wheels 35*a*, which preferably have 24 teeth, are rotatable but fixed in position.

The lifting system B comprises a supporting part 19 mounted on the chassis 35 of the movable carriage by means of eight screws. A turntable support 20 is mounted on the supporting part 19 by means of a bearing so as to be rotatable thereon. An extendible and/or retractable mast system is pivotally connected by means of hinge KK' to the turntable support 20. The turntable support 20, and therefore the lifting mast system is rotatable through a maximum of 200° by means of a hydraulically operated gearing arrangement comprising a hydraulic piston and cylinder arrangement 32 and a set of right angle gear wheels, that is a bevel gear arrangement.

The extendible and/or retractable mast system comprises telescopically arranged square cross-section tubes 21, 22 and 23, the tube 23 being of the smallest cross-section. A telescope jack or piston and cylinder arrangement 24 is provided inside the largest cross-section tube 21. One end of the jack 24 is mounted to the hinge KK' and the other end is mounted to the tube 22 by a hinge RR' so that extension or retraction of the jack 24 causes oorreaponding extension or retraction of the tube 22. The smallest cross-section tube 23 can only be extended or retracted manually, the desired extension of the tube 23 from the intermediate cross-section tube 22 being determined by a manually positionable pin LL'.

The cylinder of a piston and cylinder arrangement 31 is connected by means of a hinge MM' to a side surface of the turntable support 20 while the piston of the piston and cylinder arrangement 31 is connected by means of a hinge NN' to the end of the intermediate cross-section tube 22 closest to the tube 21 so that extension and retraction of the piston of the piston and cylinder arrangement 31 causes the lifting mast system to rotate about the hinge KK'.

A winch 25 operable by means of a hydraulic motor (not shown) is rotatably mounted to the side of the turntable support 20. A cable 26 wound onto the winch passes over a double pulley 27 rotatably mounted to a free end of the mast unit and a free end of the cable 26 is secured to a movable single pulley 28 provided with a hook 29 for engaging an object, in this case a pipe casing, 30 to be lifted by the lifting mast unit.

Assuming a winch load capacity of 0.5 tons, then the maximum load which could be lifted by the lifting mast unit is $0.5 \times 3 = 1.5$ tons. If a safety factor of 1.5 is assumed, then the safe load capacity of the lifting mast is 1 ton.

Figure 2:
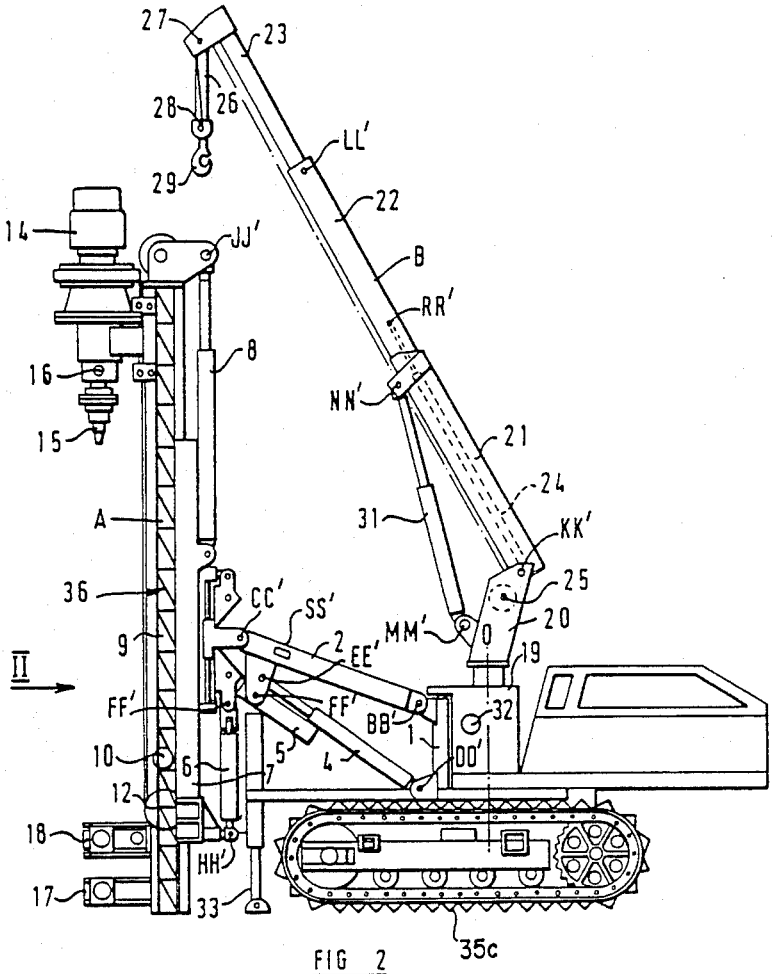
FIG. 2 is a side elevational view of the machine of FIG. 1 with the drilling mast system in a vertical position.

As shown most clearly in FIG. 2, two hydraulic jack or piston and cylinders arrangements 33 are provided to support the machine and to ensure that the machine is balanced during lifting or drilling.

Figure 7:
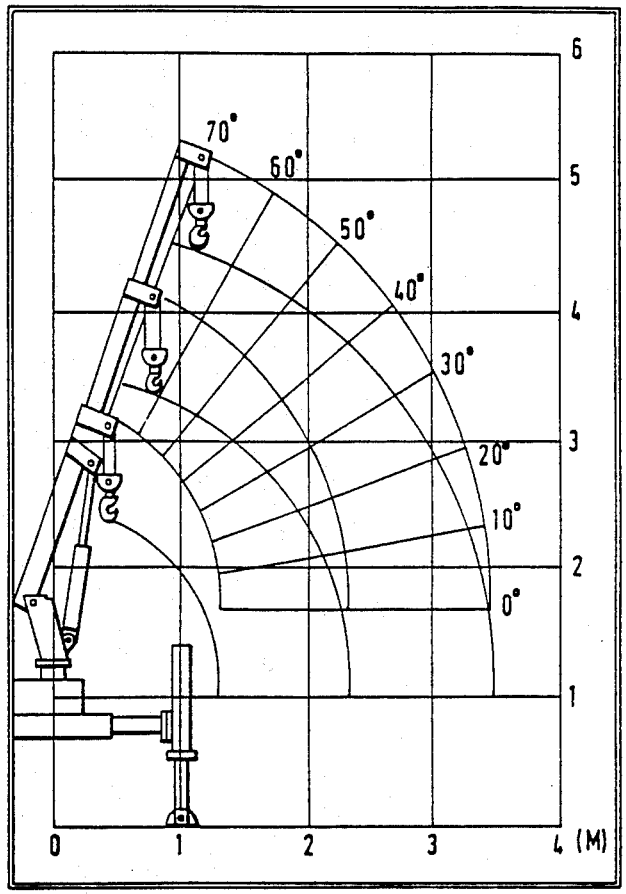
FIG. 7 is a schematic view of the lifting mast system illustrating graphically lifting distances and elevations.

FIG. 7 illustrates graphically various different extensions in meters of the lifting mast and various different angles of elevation therefor.

The drilling mast system A is mounted to the carriage by a support means comprising a raising means for moving the drilling system from a horizontal to a vertical position and vice versa, in particular for rotating the drilling mast system about a horizontal axis so that the drilling mast system rotates in a vertical plane which extends longitudinally of the carriage. The support means comprises a boom 2 having one end connected via a hinge BB' to a bearing pipe 1. The other end of the boom 2 is connected by means of a hinge CC' to a bearing plate 3 so that the bearing plate cannot rotate with respect to boom 2. The bearing plate 3 is rotatably received in a circular bearing 3*a* secured to a mast sliding bed 7. A cylinder of a piston and cylinder arrangement 5 is connected to the boom 2 by means of a hinge FF' while the piston of the piston and cylinder arrangement 5 is connected by means of a hinge GG' to the bearing plate 3. Thus, when the piston and cylinder arrangement 5 is actuated the bearing plate 3, and therefore the mast sliding bed, can be turned through up to 90° about the hinge CC' from the vertical to the horizontal or vice versa. One end of a hydraulic piston and cylinder arrangement 4 is connected to the bearing pipe 1 by means of a hinge DD' and the other end thereof is connected to the boom 2 by means of a hinge EE'. Thus, when the hydraulic piston and cylinder arrangement 4 is actuated, the boom 2 can be moved upwardly through a maximum of 45° and downwardly through a maximum of 20° to enable the drilling system to be turned in the longitudinal vertical plane about the hinge BB'.

Figure 8:
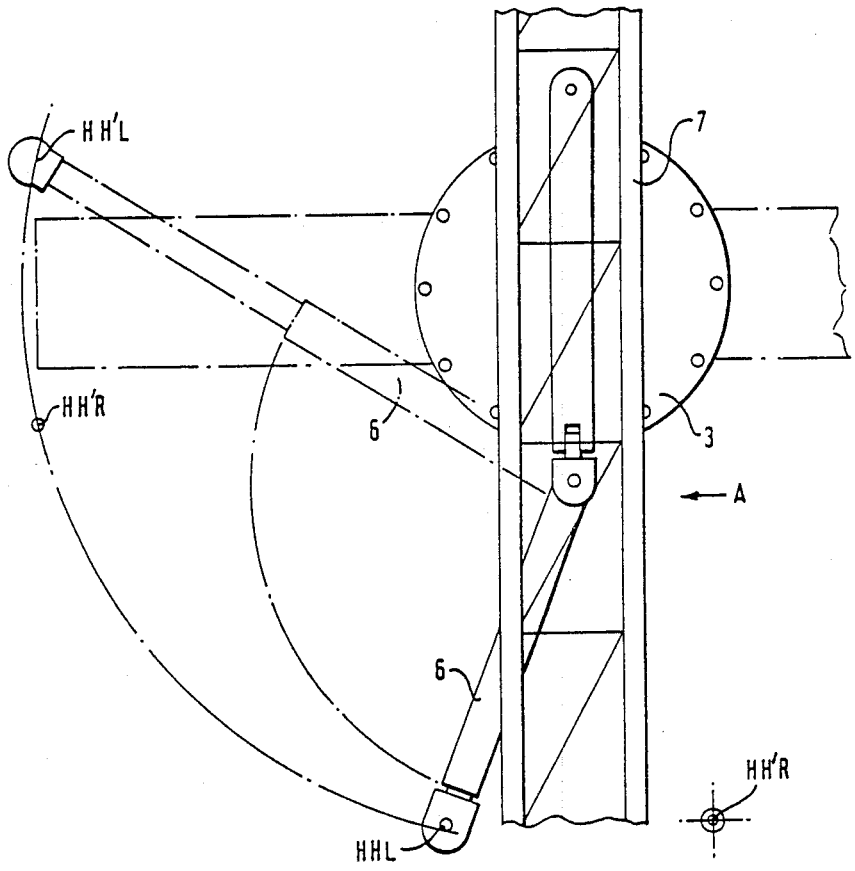
FIG. 8 is an enlarged view of the drilling mast as shown in FIG. 3 illustrating the drilling mast being moved from a vertical to a horizontal position by extension of the piston of a hydraulic piston and cylinder arrangement.

As shown in FIG. 1 and as shown schematically in FIG. 8, one end of a hydraulic piston and cylinder arrangement 6 is mounted to a hinge HH' positioned either to the left HH'L (FIG. 8) or right HH'R (FIG. 8) side of the sliding bed 7 while the other end of the hydraulic piston and cylinder arrangement 6 is connected via a hinge PP' to the bearing plate 3. Thus, when the hydraulic piston and cylinder arrangement 6 is actuated, the sliding bed 7 turns to the left or right about the central line of the bearing plate 3. FIG. 8 illustrates schematically the movement of the mast sliding bed when the hinge is positioned to the left HH'L. Thus, if the hinge HH' is positioned to the right of the sliding bed 7, the sliding bed 7 turns to the right and if the hinge HH' is positioned to the left of the sliding bed, the sliding bed 7 turns toward the left. The hinge HH' is positioned sufficiently low on the sliding bed 7 that it is easy to change between the two positions. Thus, the drilling system carried by the mast sliding bed 7 can be rotated about a horizontal axis lying in the plane of the paper in FIG. 1.

Figure 3:
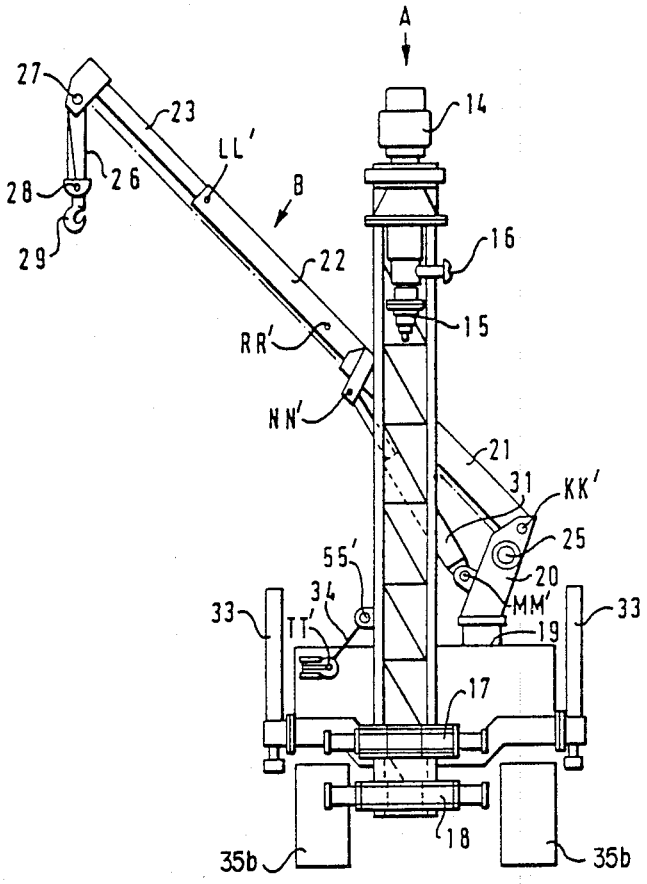
FIG. 3 is a front elevational view of the machine shown in FIG. 1 taken along the direction of the arrow II in FIG. 2 but showing a lifting mast system of the machine rotated through 90° about a vertical axis.
Figure 5:
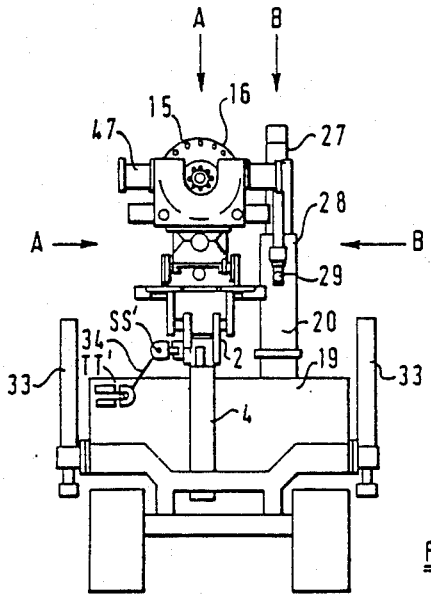
FIG. 5 is a front view of the machine as shown in FIG. 4 taken along the direction of the arrow IV in FIG. 4.

One end of a hydraulic piston and cylinder arrangement 34 is mounted to the chassis 35 by means of a hinge TT' while the other end is mounted to the boom 2 by means of a hinge SS' (FIGS. 3 and 5). Thus, by virtue of the bearing pipe 1, the support means including the boom 2 and the hydraulic piston and cylinder arrangement 4, and therefore the drilling system A, can be swung about a vertical axis in a horizontal plane to a maximum of 25° to the left or to the right about a longitudinal axis of the bearing pipe 1.

The drilling mast system A comprises a steel mast 36 which is slidably mounted within the mast sliding bed 7 by means of a hydraulic piston and cylinder arrangement 8. One end of the piston and cylinder arrangement 8 is mounted to the top of the drilling mast system A by means of a hinge JJ' and the other end is mounted to the sliding bed by means of a hinge II' so that the mast 37 can be slid longitudinally of the sliding bed 7.

FIGS. 1 to 6 and 9 illustrate various different drilling positions for the drilling mast.

FIG. 1 illustrates the drilling mast system at a 45° inclination during the performing of ground anchoring work.

As shown in FIG. 2, the mast 36 is in a position to enable a drill bit of a drill string carried thereby to drill vertically downwardly. FIG. 3 is a front view of the machine as shown in FIG. 2 but with the lifting mast system B rotated through 90° by actuation of the piston and cylinder arrangement 32. In order to drill vertically upwardly, the mast 36 is rotated through 180° about the bearing plate 3 so that the piston and cylinder arrangement 6 is disposed at the top of the mast 36.

Figure 4:
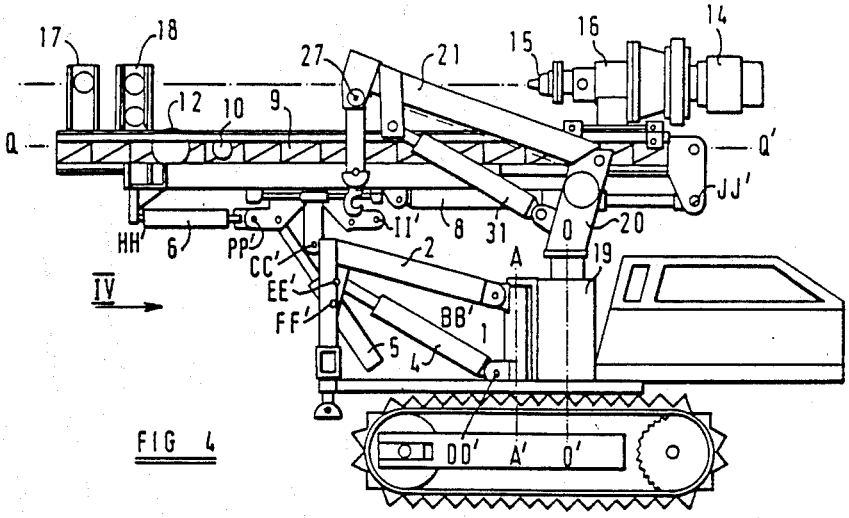
FIG. 4 is a side elevational view of the machine of FIG. 1 with the drilling and lifting mast systems in position for transport.
Figure 6:
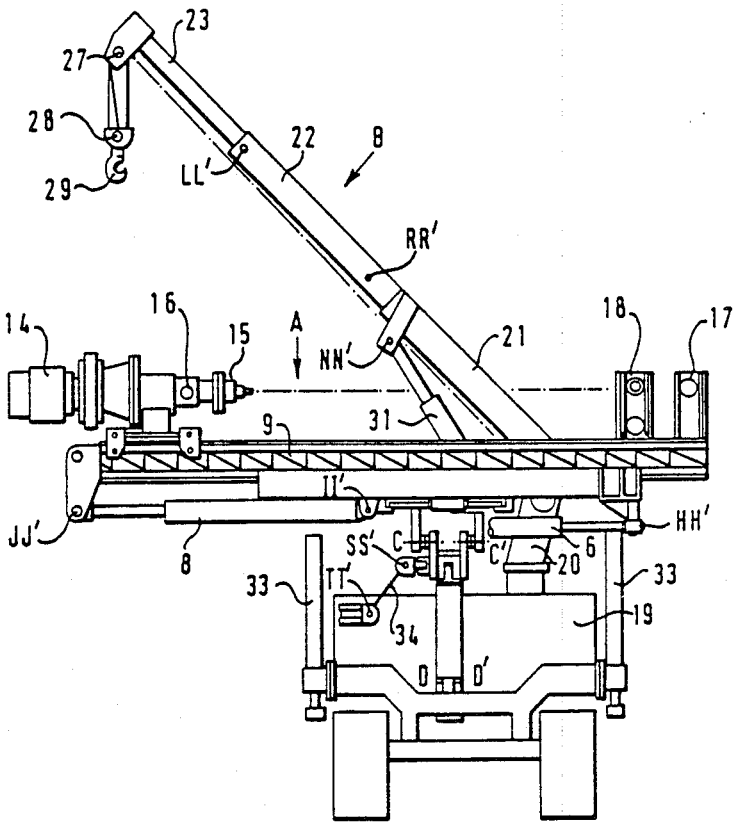
FIG. 6 is a front view of the machine of FIG. 1 showing the drilling mast system in a horizontal position.

FIGS. 4 and 5 illustrate schematically the drilling mast system and the lifting mast system in a position for transport to enable the machine to be moved to another site, the Pistons of the piston and cylinders 33 having been retracted as shown. FIG. 6 is similar to FIG. 5 but illustrates the drilling mast system rotated through 90° by the piston and cylinder arrangement 34 and the lifting mast system extended by actuation of the piston and cylinder arrangement 31.

Figure 9:
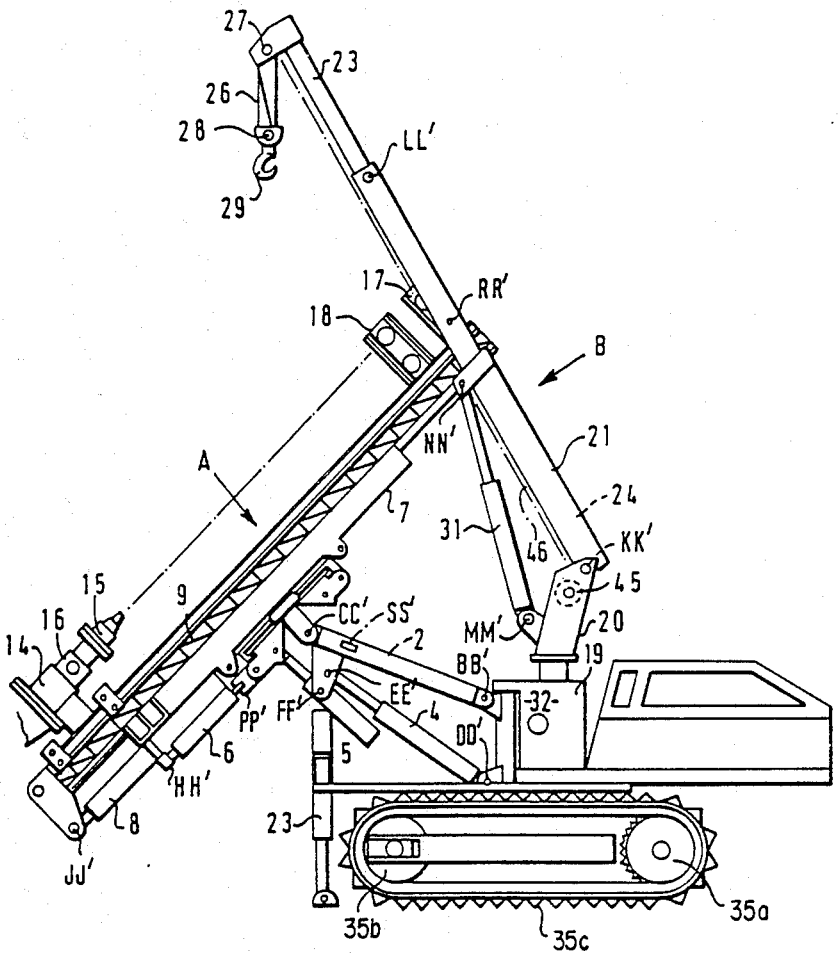
FIG. 9 is a side elevational view of the track-mounted machine of FIG. 1 showing the drilling mast in a position for enabling upward drilling at an angle of 45° to the horizontal to be carried out.

FIG. 9 shows the lifting mast system extended and the drilling mast system rotated through 180° from the position shown in FIG. 1 to enable upward drilling at an angel of 45° to the horizontal to be carried out.

As shown in FIG. 1 a rotary drill head 14 for supporting and rotating a drill and a casing therefor are mounted on a cradle 13. The rotary drill head 14 is provided with a flushing inlet or aperture 16 for enabling flushing fluid to be supplied to a drill rod connected to the rotary head. The inlet 16 of the flushing unit is at a right angle to the bottom of the rotary head and is arranged so that it does not pass through the center hereof and therefore does not interfere with the action of the rotary head.

The rotary head has an adapter 15 having three screw-threaded flange adapter sections for engaging a drill rod and a casing therefor. The rotary head may also carry a hydraulic chuck for connecting a drilling tool to the rotary head. A motor is provided to rotate the head 14.

The cradle 13 is mounted on rails of the drilling mast unit A so as to be slidable therealong by means of a hydraulic piston and cylinder arrangement 9 mounted within the drilling mast 36. An upper end of the hydraulic piston and cylinder arrangement 9 is fixed to the mast 36 by means of a hinge QQ' while a front end of the piston thereof is fixed to a movable three-part pulley system 10. A cable or wire carrying the cradle 13 is trained over the movable three-part pulley system 10 and a further pulley system 11 is provided at an upper part of the drilling mast so that when the piston and cylinder arrangement 9 is actuated, the cradle 13 is moved up and down the mast by means of the pulley system 10 and 11. A wire adjusting point and a wire adjusting unit are provided to enable the tension in the wire or cable of the pulley system to be adjusted.

As can be seen from the Figures, in particular FIGS. 1 and 2, the hydraulic piston and cylinder arrangement 9 is mounted so that the cylinder is at the top of the drilling mast and the piston is at the bottom thereof so that when the piston is extended, the push force is greater than when the piston is retracted because the area at the cylinder side is bigger than the area at the piston side. The advantage of installing the hydraulic piston and cylinder arrangement 9 in this manner is that a relatively greater pull load can be expected when extracting a casing from a drilled hole while a relatively smaller load would be expected during drilling. If the hydraulic piston and cylinder arrangement 9 were installed so that the cylinder were at the bottom and the piston were at the top, the push force developed would be greater than the weight of the machine causing the machine to lift up during drilling and the pull force developed would not be sufficient to extract the casing when a drill hole had been completed.

A hydraulic drill rod or casing clamping unit 17 and a hydraulic drill rod or casing twisting or turning and clamping unit 18 are mounted at the end of the mast remote from the rotary head 14, that is adjacent a nose of the mast.

Figure 12:
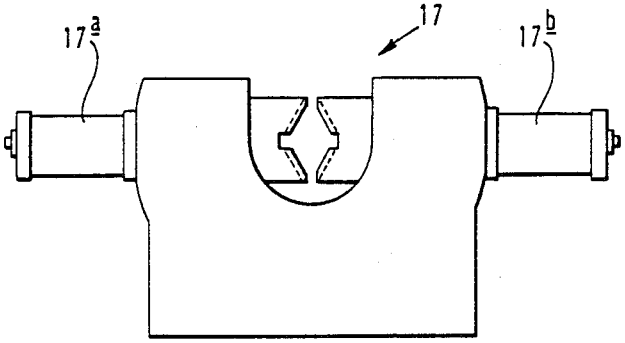
FIG. 12 is a schematic view of a hydraulic pipe clamp of the machine of FIG. 1.
Figure 13:
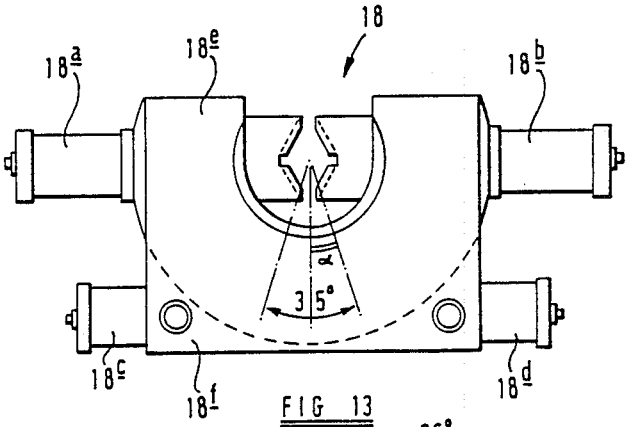
FIG. 13 is a front elevational view of a hydraulic type twisting clamp.

The clamping unit 17 is illustrated schematically in FIG. 12 while the twisting unit 18 is illustrated schematically in FIG. 13. The clamping unit 17 is in the form of a hydraulic clamp comprising a pair of hydraulic piston and cylinder arrangements 17*a* mounted to a frame 17*b* which is fixed to the mast. The rod clamping unit is used to clamp a drill rod or the like so as to assist in the removal thereof from a drill bore when the mast hydraulic piston and cylinder arrangement 9 is actuated to pull a drill rod or the like connected thereto out of a drilled bore.

As shown in FIG. 13, the twisting or turning unit 18 which is mounted between the clamping unit 17 and the rotary drill head 14 comprises four hydraulic cylinders 18*a*, 18*b*, 18*c* and 18*d* and a U-shaped frame 18*e*. Two of the cylinders 18*a* and 18*b* are mounted on the frame 18*e* to clamp a drill rod or a similar tool while the other two cylinders 18*c* and 18*d* are mounted to a frame 18*f* which is fixed to the mast. The U-shaped frame is rotatably supported by a bearing plate and can be rotated using the hydraulic cylinders 18*a*, 18*b*, 18*c*, and 18*d* through an angle of preferably 40° to turn or twist a drill rod or like tool mounted to the drill mast so as to assist in the removal thereof after the drilling operation or like, particularly if the drill rod or the like is jammed or stuck inside the drill bore.

The operating procedure of the machine will be described with reference to the example of angled hole drilling shown in FIG. 1 to explain how the machine provides lifting and drilling functions simultaneously.

As shown in FIG. 1, the machine is drilling a hole or bore downwardly at an angle of approximately 45° to the vertical. The machine is located such that the two foot piston and cylinder arrangements 33 are six feet six inches (1.96 m) away from the sheet-pile and the center of the bore or hole C approximately five feet (1.5 m) above the ground.

Figure 10:
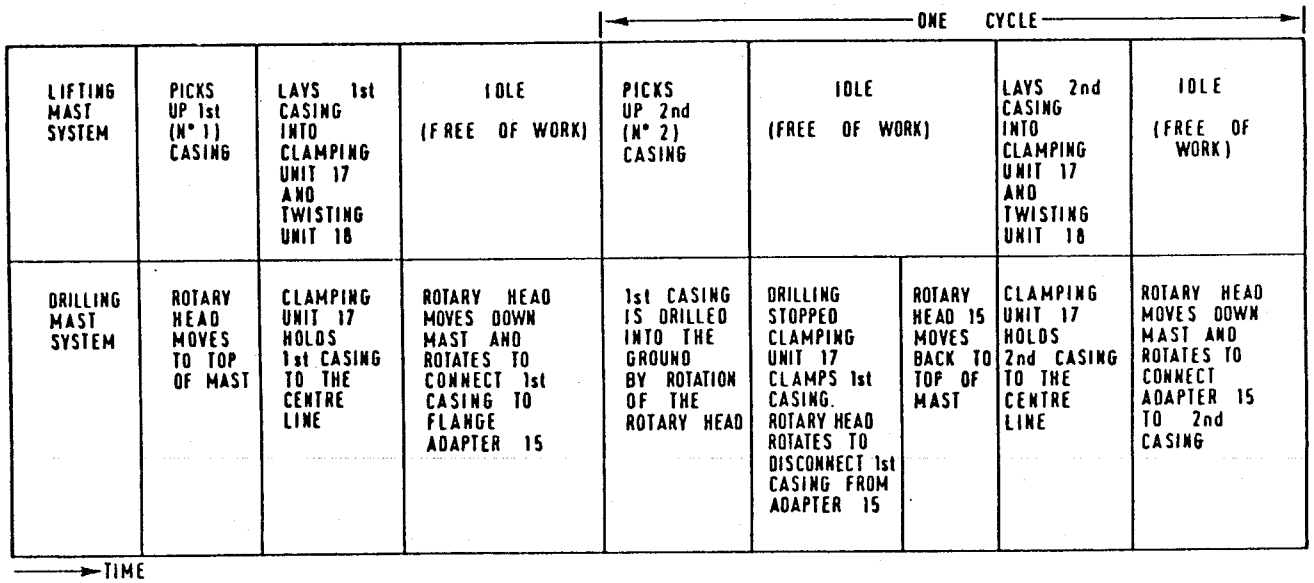
FIG. 10 is a chart illustrating the sequence of operations of the lifting and drilling mast systems during insertion of casing into a bore.

FIG. 10 is timing diagram or chart illustrating the operation of and cooperation between the lifting and drilling systems during the attachment of a pipe or casing to the string while FIG. 11 illustrates the operation and cooperation between the lifting and drilling systems during detachment or removal of a pipe casing or rod from the string. It should be appreciated that the 1st and 2nd casings referred to in FIGS. 10 and 11 are not necessarily the same casings.

After the machine has been located, the lifting mast picks up a drill casing set (including a casing bit and a casing) and lays the set down into the drill guide formed by the pipe clamping units 17 and 18. The clamping units are hydraulically controlled to adjust the two jaws thereof to provide an internal diameter which is bigger than the casing's outside diameter. Then the lifting mast is adjusted to position the drill tool ready to connect to the flange adapter. After the top of the flange has been connected to the flange adapter 15, the casing is drilled into the hole with or without the supply of flushing fluid through the flushing aperture 16. Drilling is stopped when the drill casing has sunk into the ground. Then the casing is clamped by the pipe clamping unit 17 and the rotation of the rotary head is reversed to unscrew the flange adapter 15 from the casing. The rotary head 14 is then hoisted back to the top of the mast by the control hoist piston and cylinder arrangement 9 and the steel wire. As the rotary head 14 inserts one casing 30' the lifting mast system B lifts up a second casing 30 and keeps the second casing 30 in a waiting position over the drill mast (as shown in FIG. 1). Now the second casing can be put into the right position between the first casing and the flange adapter 15 and liked to them. The next drilling cycle can then be started to add further casings to the string. From the above description it is clearly shown that the time for lifting coincides with that for drilling and thus efficiency is increased.

In order to remove a casing from a string, as illustrated in FIG. 11, drilling is first stopped and the first or uppermost casing is pulled out of the bore by moving the rotary head 15 up the mast. The clamping unit 17 then clamps the next or second casing and rotation of the rotary head is reversed to disconnect the first and second casings. If necessary, the twisting unit 18 should be used to disconnect the casings. The twisting unit 18 then clamps the first casing and the rotary head is reversed to disconnect the first casing from the flange adapter 15. The lifting mast system then picks up the first casing and transfers the casing to a storage position. The rotary head is at that time moved down the mast and rotated to connect the flange adapter 15 to the next or 2nd casing. The clamping unit 17 then clamps the third casing and the rotary head 15 is reversed to disconnect the second and third casings. The cycle or procedure is repeated until all the desired casings have been removed from the bore.

It is readily apparent that the above-described drilling and/or lifting machine meets all of the objects mentioned above and also has the advantage of wide commercial utility. It should be understood that the specific form of the invention hereinabove described is intended to be representative only, as certain modification within the scope of these teachings will be apparent to those skilled in the art.

Accordingly, reference should be made to the following claims in determining the full scope of the invention.

What is claimed is:

1. A machine comprising:

a movable carriage;

a first means for lifting and carrying a tool comprising a drilling mast.

support means mounting the first lifting and tool carrying means on the carriage to enable the first lifting and tool carrying means to be positioned in a selected one of a plurality of different positions; and a second means for lifting and carrying a tool mounted on the carriage so as to be movable either with or independently of the first lifting and tool carrying means;

said support means comprising a bearing pipe mounted on said carriage for rotation about a vertical axis, a boom member pivotally mounted on said bearing pipe, bearing means hingedly mounted on an end of said boom member, guide means rotatably mounted on said bearing means for rotation about a first axis perpendicular to a hinge axis of mounting of the bearing means on the boom member, said first lifting and tool carrying means being slideably mounted on said guide means, an extendible member pivotally connected between said boom member and said bearing means for pivoting said bearing means about said hinge axis through an angle of 90°, a further extendible member pivotally mounted between said bearing pipe and said end of said boom member for raising and lowering said boom member through an upward angle of 45° and a downward angle of 20°, a still further extendible member pivotally mounted between said end of said boom member and a side part of said carriage for rotating said boom member and said bearing pipe about said vertical axis through an angle of 25° to either side of centerline of the carriage, and an extendible arm selectively connected between said bearing means and either of a pair of hinge points on either side of a longitudinal axis of said guide means at an end of said guide means remote from said bearing means for rotating said guide means about said first axis through an angle of 240°;

whereby lifting and tool working can be performed simultaneously by said first and second lifting and tool carrying means.

2. A machine according to claim 1, wherein the first lifting and tool carrying means is slidable by means of a piston and cylinder arrangement.

3. A machine according to claim 2, wherein clamping means are mounted to the mast.

4. A machine according to claim 3, wherein the clamping means comprises a hydraulic piston and cylinder arrangement.

5. A machine according to claim 2, which further comprises gripping and turning means mounted to the mast.

6. A machine according to claim 5, wherein said gripping and turning means comprises means for gripping a tool including a frame rotatably mounted on the mast and two piston and cylinder arrangements mounted on siad frame, and for turning said frame means including two further piston and cylinder arrangements for effecting rotation of the frame relative to the mast.

7. A machine according to claim 5, wherein said drilling mast has means for supporting and driving a drilling tool.

8. A machine according to claim 7, wherein the supporting and driving means comprises a rotary drill head.

9. A machine according to claims 1, wherein said carriage is powered to move the machine over a surface.

10. A machine according to claim 1 wherein the second lifting and/or tool means is arranged to lift items for supplying to the first lifting and tool carrying means.

11. A machine according to claim 10, wherein the second lifting tool carrying means comprises a telescopic arm member having one end mounted to the carriage and the other end carrying means for engaging a tool or load.

12. A machine according to claim 11, wherein the telescopic arm member comprises a plurality of telescopable tubes.

13. A machine according to claim 12, wherein a first tube is extendible from and retractable into a second tube of the plurality of telescopable tubes by means of a piston and cylinder arrangement.

* * * * *